US009593639B2

(12) United States Patent
Batta

(10) Patent No.: US 9,593,639 B2
(45) Date of Patent: Mar. 14, 2017

(54) CYLINDER LINER HAVING ANNULAR COOLANT CIRCULATION GROOVE

(71) Applicant: Caterpillar Inc., Peoria, IL (US)

(72) Inventor: Christopher Lee Batta, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 105 days.

(21) Appl. No.: 14/463,219

(22) Filed: Aug. 19, 2014

(65) Prior Publication Data

US 2016/0053708 A1 Feb. 25, 2016

(51) Int. Cl.

| | |
|---|---|
| ***F02F 1/10*** | (2006.01) |
| ***F02F 1/00*** | (2006.01) |
| ***F02F 1/16*** | (2006.01) |
| ***F02F 1/14*** | (2006.01) |
| *B22D 19/00* | (2006.01) |
| *F02F 1/20* | (2006.01) |

(52) U.S. Cl.

CPC ..... *F02F 1/004* (2013.01); *F02F 1/14* (2013.01); *F02F 1/16* (2013.01); *B22D 19/0009* (2013.01); *F02F 1/20* (2013.01)

(58) Field of Classification Search

CPC ..... F02F 1/004; F02F 1/20; B22D 19/0009; F05C 2201/021

USPC ..... 123/193.2

See application file for complete search history.

(56) References Cited

U.S. PATENT DOCUMENTS

| | | | | |
|---|---|---|---|---|
| 5,165,367 | A * | 11/1992 | Morris | F16J 9/206 123/41.84 |
| 5,596,954 | A | 1/1997 | Kennedy | |
| 6,164,260 | A | 12/2000 | Bock | |
| 6,675,750 | B1 | 1/2004 | Wagner | |
| 8,601,995 | B2 | 12/2013 | Worthington et al. | |
| 2006/0219192 | A1 | 10/2006 | Rasmussen | |

* cited by examiner

*Primary Examiner* — Lindsay Low
*Assistant Examiner* — Charles Brauch
(74) *Attorney, Agent, or Firm* — Finnegan, Henderson, Farabow, Garrett & Dunner, LLP

(57) ABSTRACT

A cylinder liner is disclosed for use with an engine. The cylinder liner may have a hollow generally cylindrical body with a top end and a bottom end, and a flange extending radially outward at the top end of the hollow generally cylindrical body. The cylinder liner may also have a seal end stop formed on an outer annular surface of the hollow generally cylindrical body an axial distance away from the flange, and an annular groove formed within the outer annular surface of the hollow generally cylindrical body at a location between the end stop and the bottom end.

15 Claims, 2 Drawing Sheets

CYLINDER LINER HAVING ANNULAR COOLANT CIRCULATION GROOVE

TECHNICAL FIELD

The present disclosure relates generally to a cylinder liner and, more particularly, to a cylinder liner having an annular coolant circulation groove.

BACKGROUND

An internal combustion engine includes an engine block defining a plurality of cylinder bores, and pistons that reciprocate within the cylinder bores to generate mechanical power. Typically, each cylinder bore includes a replaceable liner. The liner has a cylindrical body that fits within the cylinder bore, and a radial flange at a top end of the body that supports and positions the cylinder liner on the engine block. In some embodiments, a cavity is formed around the liner, and coolant is directed through the cavity to cool the liner.

An exemplary cylinder liner is disclosed in U.S. Patent Publication No. 2006/0219192 of Rasmussen that published on Oct. 5, 2006 ("the '192 publication"). This cylinder liner includes a parabolic cooling groove machined into an outer surface immediately below a radially extending flange. The flange is compression fit against an engine block so as to create a fluid seal that inhibits coolant from leaking out of the cooling groove. The cooling groove has a radius of 0.320" and a width of 0.472", and is intended to provide a location for coolant to move upward and inward toward a firing zone of an associated engine, thereby enhancing cooling of the cylinder liner.

Although the cooling groove of the '192 publication may enhance cooling of the cylinder liner, the cylinder liner may still be less than optimal. In particular, it may be possible for the flange to not seal completely against the engine block. And because of the location of the cooling groove being immediately adjacent the flange, coolant could leak out of the cooling groove and past the flange/block interface.

The cylinder liner of the present disclosure solves one or more of the problems set forth above and/or other problems in the art.

SUMMARY

In one aspect, the present disclosure is directed to a cylinder liner. The cylinder liner may include a hollow generally cylindrical body having a top end and a bottom end, and a flange extending radially outward at the top end of the hollow generally cylindrical body. The cylinder liner may also include a seal end stop formed on an outer annular surface of the hollow generally cylindrical body an axial distance away from the flange, and an annular groove formed within the outer annular surface of the hollow generally cylindrical body at a location between the end stop and the bottom end.

In another aspect, the present disclosure is directed to a cylinder liner assembly. The cylinder liner assembly may include a cylinder liner having a hollow generally cylindrical body with a top end and a bottom end, a flange extending radially outward at the top end of the hollow generally cylindrical body, and an annular groove formed within the outer annular surface of the hollow generally cylindrical body. The cylinder liner assembly may also include a seal disposed around the hollow generally cylindrical body at an axial location between the flange and the annular groove.

In yet another aspect, the present disclosure is directed to an engine. The engine may include a cylinder block at least partially defining a plurality of cylinder bores, and at least one cooling passage directed radially into each of the plurality of cylinder bores. The engine may also include a cylinder liner assembly disposed within each of the plurality of cylinder bores. The cylinder liner assembly may have a cylinder liner with a hollow generally cylindrical body having a top end and a bottom end, and a flange extending radially outward at the top end of the hollow generally cylindrical body. The cylinder liner may also have an annular groove formed within the outer annular surface of the hollow generally cylindrical body in general axial alignment with the at least one cooling passage. The cylinder liner assembly may further include a seal located disposed around the hollow generally cylindrical body at an axial location between the flange and the annular groove.

DETAILED DESCRIPTION

Figure 1:
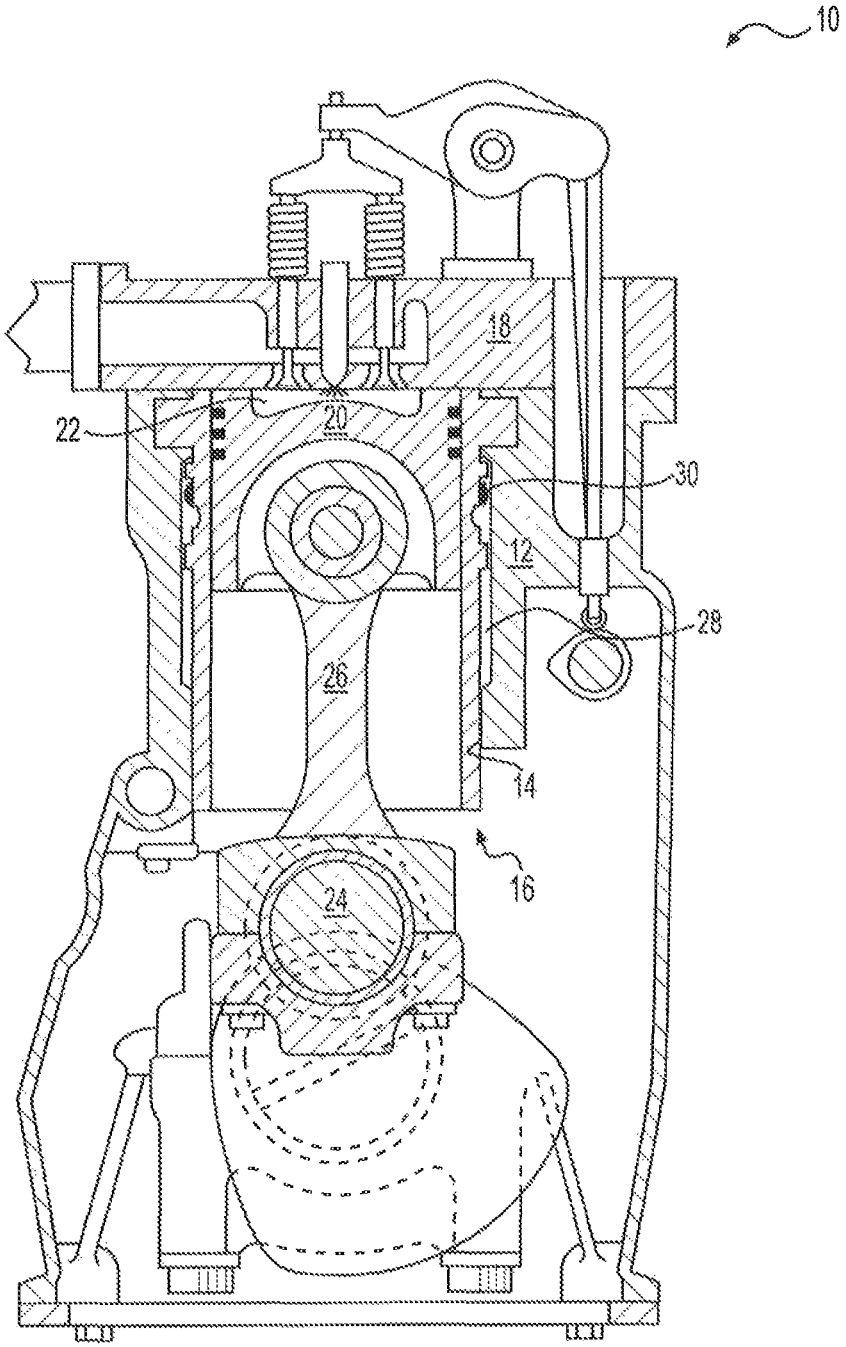
FIG. 1 is a cross-sectional illustration of an exemplary disclosed engine.

FIG. 1 illustrates a portion of an exemplary internal combustion engine 10. Engine 10 may include an engine block 12 defining at least one cylinder bore 14. A cylinder liner assembly 16 may be disposed within cylinder bore 14, and a cylinder head 18 may be connected to engine block 12 to close off an end of cylinder bore 14. A piston 20 may be slidably disposed within cylinder liner assembly 16, and piston 20 together with cylinder liner assembly 16 and cylinder head 18 may define a combustion chamber 22. It is contemplated that engine 10 may include any number of combustion chambers 22 and that combustion chambers 22 may be disposed in an "in-line" configuration, in a "V" configuration, in an opposing-piston configuration, or in any other suitable configuration.

Piston 20 may be configured to reciprocate within cylinder liner assembly 16 between a top-dead-center (TDC) position and a bottom-dead-center (BDC) position to facilitate a combustion process with chamber 22. In particular, piston 20 may be pivotally connected to a crankshaft 24 by way of a connecting rod 26, so that a sliding motion of each piston 20 within cylinder liner assembly 16 results in a rotation of crankshaft 24. Similarly, a rotation of crankshaft 24 may result in a sliding motion of piston 20. In a two-stroke engine, piston 20 may move through two full strokes to complete a combustion cycle that includes a power/exhaust/intake stroke (TDC to BDC) and an intake/compression stroke (BDC to TDC). In a four-stroke engine, piston 20 may move through four full strokes to complete a combustion cycle that includes an intake stroke (TDC to BDC), a compression stroke (BDC to TDC), a power stroke (TDC to BDC), and an exhaust stroke (BDC to TDC). Fuel (e.g., diesel fuel, gasoline, gaseous fuel, etc.) may be injected into combustion chamber 22 during the intake strokes of either combustion cycle. The fuel may be mixed with air during the compression strokes and ignited. Heat and pressure resulting from the fuel/air ignition may then be converted to useful mechanical power during the ensuing power strokes. Residual gases may be discharged from combustion chamber 22 during the exhaust strokes.

Heat from the combustion process described above that could damage engine 10, if unaccounted for, may be dissipated from cylinder bore 14 by way of a water jacket 28. Water jacket 28 may be located between an internal wall of cylinder bore 14 and an external wall of cylinder liner assembly 16. For example, water jacket 28 may be formed by a recess within engine block 12 at the internal wall of cylinder bore 14 and/or within the external wall of cylinder liner assembly 16. It is contemplated that water jacket 28 may be formed completely within engine block 12 around cylinder liner assembly 16, formed completely within cylinder liner assembly 16, and/or formed by a hollow sleeve (not shown) that is brazed to either one of engine block 12 or cylinder liner assembly 16, as desired. Water, glycol, or a blended mixture may be directed through water jacket 28 to absorb heat from engine block 12 and cylinder liner assembly 16.

Cylinder liner assembly 16 may be an assembly of at least two main components, including a cylinder liner ("liner") 32 and a seal 30. Seal 30 may be disposed around cylinder liner assembly 16 to seal off an upper end of water jacket 28. Seal 30 may be sandwiched between an outer wall of cylinder liner assembly 16 and an inner wall of cylinder bore 14, after assembly, such that coolant within water jacket 28 is inhibited from leaking out of engine block 12 through a top of cylinder bore 14. Seal 30 may be, for example, an o-ring type seal fabricated from a resilient material.

Figure 2:
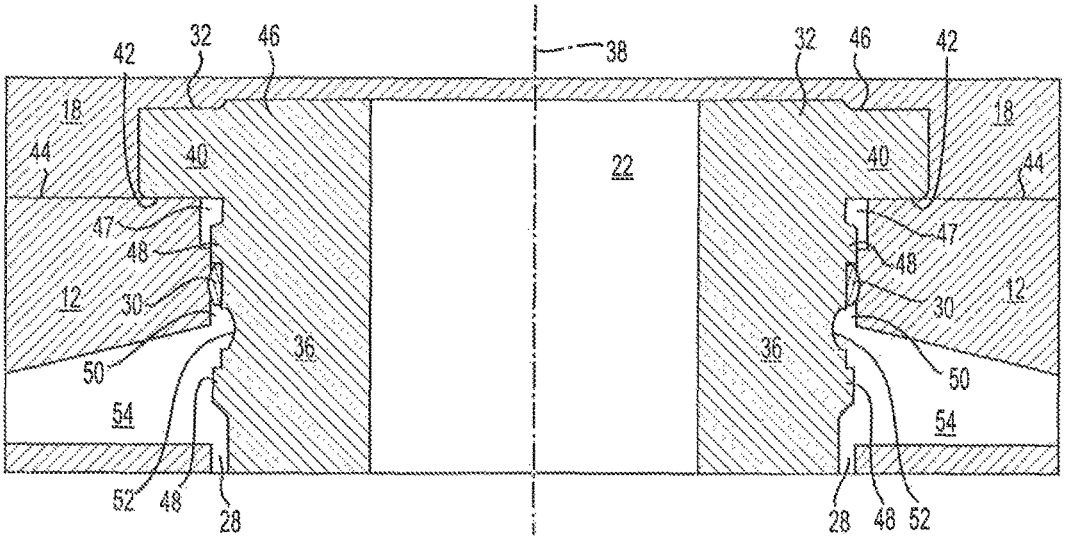
FIG. 2 is a cross-sectional illustration of a portion of cylinder liner that may be used in conjunction with the engine of FIG. 1.

As shown in FIG. 2, liner 32 may have a hollow generally cylindrical body 36 extending along a longitudinal axis 38, and an annular flange 40 protruding radially outward at a top or exposed end of body 36. A lower face 42 of flange 40 may be configured to engage an upper face of 44 of engine block 12, while an upper face 46 of flange 40 may be configured to engage cylinder head 18. An annular channel 47 may be formed under flange 40 (i.e., at an inside corner of body 36 and flange 40) to function as an overflow or backup coolant collection cavity. In particular, any coolant that leaks from water jacket 28 past seal 30 may be collected within channel 47, and the engagement of lower face 42 with upper face 44 may inhibit this collected coolant from escaping channel 47.

Seal 30 may be retained at a desired axial location on liner 32 by spaced-apart end stops 48 located at opposing sides of seal 30. Water jacket 28 may fluidly communicate with a lower half of seal 30 via an annular passage 50 formed by a difference of liner and bore diameters at an axial location between end stops 48. This communication may help to cool seal 30.

An annular groove 52 may be formed within an outer surface of body 36 at an axial location between end stops 48. In the disclosed embodiment, annular groove 52 is shown as being located closer to the lower one of end stops 48 (e.g., between seal 30 and the lower end stop 48), although other configurations may also be possible. A radially oriented fluid passage 54 may be formed within engine block 12 and configured to direct coolant into water jacket 28, passage 50, and groove 52. Passage 54 may terminate at the general axial location of groove 52, so as to force coolant through groove 52 and around body 36. Groove 52 may be in communication with passage 50 (e.g., located at an entrance of passage 50) and function to enhance coolant circulation within passage 50 and up against seal 30. In this way, the cooling of seal 30 may be improved.

In the disclosed embodiment, annular groove 52 has a cross-section that is cove-shaped. Specifically, annular groove 52 may have a smooth generally symmetrical curved surface (i.e., relative to an axial center), with a radius of about 4-5 mm and rounded axial edges that intersect with the outer annular surface of body 36. The location and depth of groove 52 may reduce a wall thickness of body 36 by about 1-2%, thereby enhancing heat transfer at this location. A center of groove 52 may be located axially about 5-6% of a distance from flange 40 to the bottom end of body 36. For example the center of groove 52 may be located about 20 mm away from lower surface 42 of flange 40. A maximum width of groove 52 (i.e., a width at the outer annular surface of body 36) may be about ¼-½ of a distance between end stops 48. For example, the maximum width may be about 4.25-8.5 mm.

INDUSTRIAL APPLICABILITY

The disclosed cylinder liner may be used in any application where it is desired to increase the reliability and operating life of the associated engine. The disclosed cylinder liner assembly may increase reliability and operating life by lowering a temperature experienced by a seal installed on the cylinder liner. This temperature may be lowered through the use of a uniquely designed cove-shaped annular groove located at an intersection of a radial coolant passage. The annular groove may enhance cooling of the seal by directing coolant from the radial passage to a lower edge of the seal. In addition, a surface area of the groove (in combination with a depth of the groove into the outer wall of the cylinder liner), may help to transfer heat from the cylinder liner to the coolant. And any coolant that happens to leak from the groove past the seal may still be trapped inside a corresponding bore of the engine by way of a backup coolant collection cavity that is located between the seal and a flange of the liner.

It will be apparent to those skilled in the art that various modifications and variations can be made to the disclosed cylinder liner assembly. Other embodiments will be apparent to those skilled in the art from consideration of the specification and practice of the disclosed cylinder liner assembly. It is intended that the specification and examples be considered as exemplary only, with a true scope being indicated by the following claims and their equivalents.

What is claimed is:

1. A cylinder liner, comprising:

a hollow generally cylindrical body having a top end and a bottom end;

a flange extending radially outward at the top end of the hollow generally cylindrical body;

a seal end stop formed on an outer annular surface of the hollow generally cylindrical body an axial distance away from the flange; and an annular groove formed within the outer annular surface of the hollow generally cylindrical body at a location between the seal end stop and the bottom end;

wherein:

the seal end stop is a first seal end stop;

the cylinder liner includes a second seal end stop formed on the outer annular surface of the hollow generally cylindrical body at an axial location between the first seal end stop and the bottom of the hollow generally cylindrical body;

the annular groove is located between the first and second seal end stops; and the annular groove is located closer to the second seal end stop than the first seal end stop.

2. The cylinder liner of claim 1, wherein the annular groove has a cove shape.

3. The cylinder liner of claim 2, wherein the cove shape has a radius of about 4-5 mm.

4. The cylinder liner of claim 2, wherein the cove shape reduces a wall thickness of the hollow generally cylindrical body by about 1-2%.

5. The cylinder liner of claim 2, wherein an axial center of the cove shape is located about 5-6% of an axial distance from the flange to the bottom end of the hollow generally cylindrical body.

6. The cylinder liner of claim 2, wherein axial edges of the cove shape are rounded.

7. The cylinder liner of claim 1, further including a channel formed between the flange and the first seal end stop.

8. A cylinder liner assembly, comprising:

a cylinder liner having:

a hollow generally cylindrical body with a top end and a bottom end, and an outer wall;

a flange extending radially outward at the top end of the hollow generally cylindrical body;

an annular groove formed within an outer annular surface of the hollow generally cylindrical body; and a seal disposed around the hollow generally cylindrical body and upon the outer annular surface at a first axial location between the flange and the annular groove, and the annular groove being formed in the outer annular surface at an adjacent axial location and having a radially inward extent from the outer annular surface, such that the outer wall has a first thickness at the first axial location and a reduced thickness at the adjacent axial location.

9. The cylinder liner assembly of claim 8, wherein the cylinder liner further includes a first seal end stop formed on an outer annular surface of the hollow generally cylindrical body at an axial location between the flange and the seal.

10. The cylinder liner assembly of claim 9, further including a second seal end stop formed on the outer annular surface of the hollow generally cylindrical body at an axial location between the annular groove and the bottom of the hollow generally cylindrical body.

11. The cylinder liner assembly of claim 10, wherein the annular groove is located closer to the second seal end stop than the first seal end stop.

12. The cylinder liner assembly of claim 10, further including a channel formed between the flange and the first seal end stop.

13. The cylinder liner assembly of claim 8, wherein the annular groove has a cove shape.

14. An engine, comprising:

a cylinder block at least partially defining a plurality of cylinder bores, and at least one cooling passage directed radially into each of the plurality of cylinder bores; and a cylinder liner assembly disposed within each of the plurality of cylinder bores, the cylinder liner assembly including:

a cylinder liner having:

a hollow generally cylindrical body with a top end and a bottom end;

a flange extending radially outward at the top end of the hollow generally cylindrical body; and a first seal end stop formed on an outer annular surface of the hollow generally cylindrical body at an axial location between the flange and the seal; and a second seal end stop formed on the outer annular surface of the hollow generally cylindrical body at an axial location between the at least one cooling passage and the bottom of the hollow generally cylindrical body; and an annular groove formed within an outer annular surface of the hollow generally cylindrical body in general axial alignment with the at least one cooling passage such that coolant is conveyed between the at least one cooling passage and the annular groove, wherein the annular groove is located closer to the second seal end stop than the first seal end stop, and the annular groove has a cove shape; and a seal located disposed around the hollow generally cylindrical body at an axial location between the flange and the annular groove, wherein a difference in diameters between each of the plurality of cylinder bores and a corresponding cylinder liner forms a radial passage that extends from the annular groove to the seal.

15. The engine of claim 14, further including a channel formed between the flange and the first seal end stop.

* * * * *